US010763566B2

(12) United States Patent
Noori et al.

(10) Patent No.: US 10,763,566 B2
(45) Date of Patent: Sep. 1, 2020

(54) MILLIMETER WAVE TRANSMISSION LINE STRUCTURES

(71) Applicant: Apple Inc., Cupertino, CA (US)

(72) Inventors: Basim H. Noori, San Jose, CA (US); Matthew A. Mow, Los Altos, CA (US); Simone Paulotto, Redwood City, CA (US); Khan M. Salam, Dublin, CA (US)

(73) Assignee: Apple Inc., Cupertino, CA (US)

( * ) Notice: Subject to any disclaimer, the term of this patent is extended or adjusted under 35 U.S.C. 154(b) by 336 days.

(21) Appl. No.: 15/655,727

(22) Filed: Jul. 20, 2017

(65) Prior Publication Data

US 2019/0027802 A1 Jan. 24, 2019

(51) Int. Cl.
*H01Q 3/08* (2006.01)
*H01Q 1/24* (2006.01)
(Continued)

(52) U.S. Cl.
CPC ..... *H01P 3/081* (2013.01); *H01Q 3/30* (2013.01); *H01Q 5/378* (2015.01);
(Continued)

(58) Field of Classification Search
CPC combination set(s) only.
See application file for complete search history.

(56) References Cited

U.S. PATENT DOCUMENTS 3,696,433 A * 10/1972 Killion ..... H01Q 13/10 343/770
4,513,291 A * 4/1985 Drabowitch ..... H01Q 21/0043 343/771

(Continued)

OTHER PUBLICATIONS

Aryanfar et al. "Compact Millimeter-Wave Filters Using Distributed Capacitively Loaded CPW Resonators" IEEE Transactions on Microwave Theory and Techniques, vol. 54, No. 3, Mar. 2006, pp. 1161-1165. DOI: 10 1109/TMTT.2005.864109.

(Continued)

*Primary Examiner* — Graham P Smith
*Assistant Examiner* — Jae K Kim
(74) *Attorney, Agent, or Firm* — Treyz Law Group, P.C.; Michael H. Lyons; Tianyi He

(57) ABSTRACT

An electronic device may include a millimeter wave transceiver, a first antenna having a first resonating element at a first side of a substrate, and a second antenna having a second resonating element at a second side of the substrate. A first coplanar waveguide may convey millimeter wave signals between the transceiver and the first resonating element and a second coplanar waveguide may convey millimeter wave signals between the transceiver and the second resonating element. The first coplanar waveguide may be coupled to the first resonating element through the second coplanar waveguide. The second coplanar waveguide may be coupled to the second resonating element through the first coplanar waveguide. Ground conductors in the coplanar waveguides may form antenna ground planes for the first and second antennas while serving to maximize electromagnetic decoupling between the coplanar waveguides and thus isolation between the ports of the transceiver.

20 Claims, 12 Drawing Sheets

(51) Int. Cl.

| | |
|---|---|
| ***H01Q 21/06*** | (2006.01) |
| ***H01Q 15/00*** | (2006.01) |
| ***H01Q 3/30*** | (2006.01) |
| ***H01P 3/08*** | (2006.01) |
| ***H01Q 19/00*** | (2006.01) |
| ***H01Q 9/04*** | (2006.01) |
| ***H01Q 21/28*** | (2006.01) |
| ***H01Q 5/378*** | (2015.01) |
| *H01P 3/00* | (2006.01) |
| *H01Q 21/00* | (2006.01) |

(52) U.S. Cl.

CPC ..... *H01Q 9/0414* (2013.01); *H01Q 9/0435* (2013.01); *H01Q 15/0086* (2013.01); *H01Q 19/005* (2013.01); *H01Q 21/065* (2013.01); *H01Q 21/28* (2013.01); *H01P 3/006* (2013.01); *H01Q 1/243* (2013.01); *H01Q 21/0037* (2013.01)

(56) References Cited

U.S. PATENT DOCUMENTS 4,914,407 A * 4/1990 Itoh ..... G02F 1/025 331/107 SL
5,446,425 A * 8/1995 Banba ..... H01P 5/185 333/116
5,633,613 A * 5/1997 MacDonald ..... H01Q 9/0457 332/163
5,694,134 A * 12/1997 Barnes ..... H01G 7/06 343/700 MS
5,952,709 A * 9/1999 Kitazawa ..... H05K 1/0243 257/275
6,016,092 A * 1/2000 Qiu ..... H01P 1/127 333/101
6,111,485 A * 8/2000 Carlsson ..... H01P 1/20309 333/235
6,130,483 A * 10/2000 Shizuki ..... H01L 23/66 257/778
6,512,431 B2 * 1/2003 Pergande ..... H01P 5/107 333/24 R
7,583,169 B1 * 9/2009 Scardelletti ..... H01P 1/127 333/105
7,586,386 B2 * 9/2009 Takahashi ..... H01P 5/1007 333/26
7,855,696 B2 12/2010 Gummalla et al.
8,680,689 B1 * 3/2014 Daubenspeck ..... H01L 25/0657 257/778
8,866,558 B2 10/2014 Li et al.
9,118,109 B2 8/2015 Ph et al.
9,667,290 B2 5/2017 Ouyang et al.
10,056,922 B1 * 8/2018 Tsvelykh ..... H01P 1/20
10,340,233 B1 * 7/2019 Saiz ..... H01P 11/003
2007/0222534 A1 * 9/2007 Hannah ..... H01P 3/003 333/20
2008/0278259 A1 * 11/2008 Ni ..... H01P 1/2005 333/32
2009/0174499 A1 * 7/2009 Hiramatsu ..... H01P 1/18 333/139
2010/0213584 A1 * 8/2010 Ju ..... H01L 23/66 257/660
2013/0168783 A1 * 7/2013 Ding ..... G06F 30/36 257/415
2015/0054595 A1 * 2/2015 Dewitt ..... G06F 30/394 333/117
2015/0194736 A1 7/2015 Diukman et al.
2017/0069973 A1 3/2017 Black et al.
2017/0093005 A1 * 3/2017 Ou ..... H01P 3/006
2017/0110787 A1 4/2017 Ouyang et al.
2017/0117754 A1 4/2017 Noori et al.
2018/0175476 A1 * 6/2018 Teshiba ..... H01L 24/73
2018/0219272 A1 * 8/2018 Baheti ..... H01Q 1/523

OTHER PUBLICATIONS

Noori et al., U.S. Appl. No. 15/138,684, filed Apr. 26, 2016.
Noori et al., U.S. Appl. No. 15/138,689, filed Apr. 26, 2016.
Mow et al., U.S. Appl. No. 15/217,805, filed Jul. 22, 2016.
Paulotto et al., U.S. Appl. No. 15/650,638, filed Jul. 14, 2017.
Paulotto et al., U.S. Appl. No. 15/650,627, filed Jul. 14, 2017.
Paulotto et al., U.S. Appl. No. 15/650,689, filed Jul. 14, 2017.

* cited by examiner

MILLIMETER WAVE TRANSMISSION LINE STRUCTURES

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Performing millimeter wave communications often involves the use of multiple antennas arranged in a phased antenna array. Each of the antennas in the phased antenna array is coupled to a corresponding transmission line. Operation at these frequencies supports high data rates but may raise significant challenges. For example, millimeter wave communications are often line-of-sight communications and can be characterized by substantial attenuation during signal propagation. In addition, it can be challenging to electromagnetically isolate the transmission lines coupled to each antenna in a phased antenna array at millimeter wave frequencies.

It would therefore be desirable to be able to provide electronic devices with improved wireless communications circuitry such as communications circuitry that supports communications at frequencies greater than 10 GHz.

SUMMARY

An electronic device may be provided with wireless circuitry. The wireless circuitry may include one or more antennas and transceiver circuitry such as millimeter wave transceiver circuitry. The millimeter wave transceiver circuitry and the antennas may be formed on a dielectric substrate having stacked dielectric layers.

A first antenna may include a first patch antenna resonating element formed at a first side of the substrate. A second antenna may include a second patch antenna resonating element formed at a second side of the substrate. Transmission lines such as coplanar waveguides may be used to convey signals in frequency bands between 10 GHz and 300 GHz such as millimeter wave signals between the transceiver circuitry and the first and second antennas.

For example, a first coplanar waveguide may be formed from a first layer of conductive traces between the first and second patch antenna resonating elements. A second coplanar waveguide may be formed from a second layer of conductive traces between the first and second patch antenna resonating elements. The first coplanar waveguide may be interposed between the second coplanar waveguide and the second antenna resonating element. The second coplanar waveguide may be interposed between the first coplanar waveguide and the first antenna resonating element.

The first coplanar waveguide may include a first signal conductor coupled between a first port of the millimeter wave transceiver circuitry and a first antenna feed terminal on the first patch antenna resonating element. The first coplanar waveguide may be coupled to the first patch antenna resonating element through an opening in the second coplanar waveguide. The second coplanar waveguide may include a second signal conductor coupled between a second port of the millimeter wave transceiver circuitry and a second antenna feed terminal on the second patch antenna resonating element. The second coplanar waveguide may be coupled to the second antenna resonating element through an opening in the first coplanar wave guide. The ground conductors in the first coplanar waveguide may be shorted to the ground conductors in the second coplanar waveguide. Additional coplanar waveguides may be formed from the first and second layers of conductive traces for conveying millimeter wave signals for any desired number of antenna feeds and any desired number of antennas in the device.

In another suitable arrangement, both the first and second antennas may be formed at a single side of the dielectric substrate. In this scenario, the first and second coplanar waveguides may be formed from a single layer of conductive traces interposed between an antenna ground plane and the first and second patch antenna resonating elements. The conductive traces may include first, second, and third ground conductors. The first signal conductor may be interposed between the first and second ground conductors whereas the second signal conductor is interposed between the second and third ground conductors.

The ground conductors in the first and second coplanar waveguides may serve as antenna ground planes for the antennas on one or both sides of the dielectric substrate. At the same time, the ground conductors may serve to isolate the first and second signal conductors to maximize electromagnetic decoupling between the first and second coplanar waveguides (e.g., to maximize isolation between the first and second transceiver ports).

DETAILED DESCRIPTION

Figure 1:
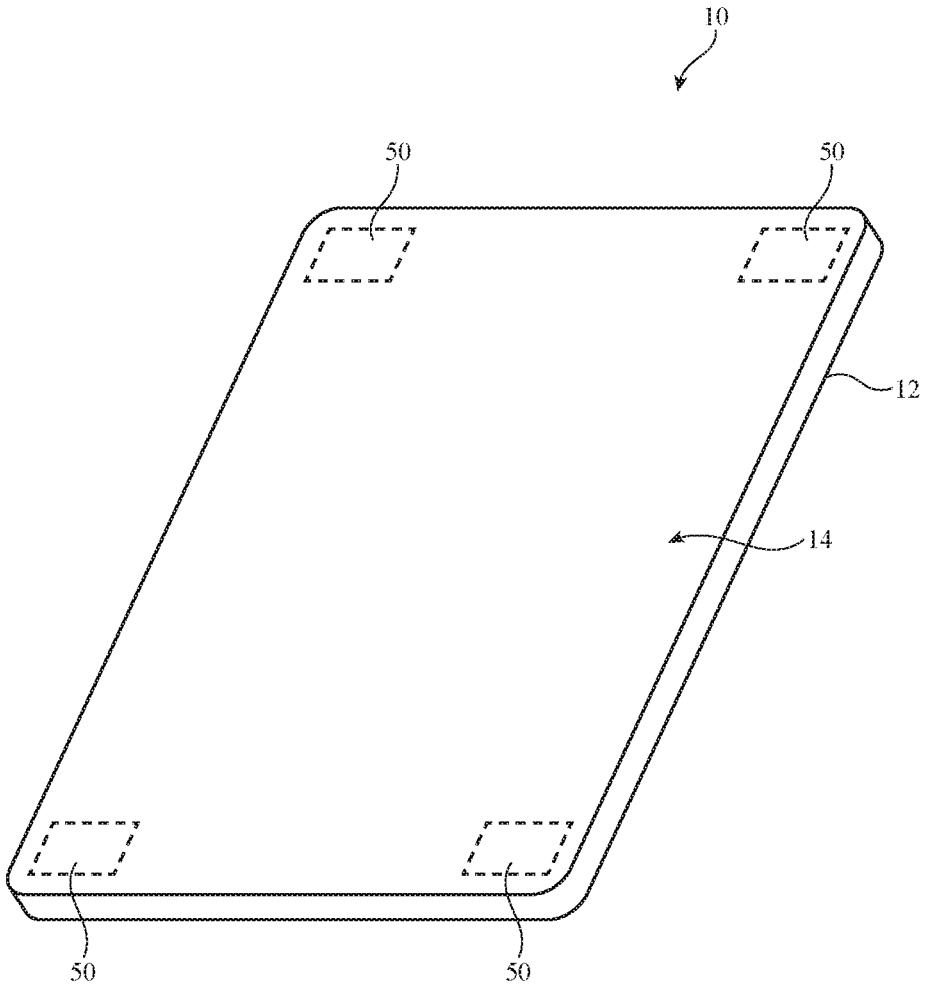
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave and centimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 14 (see, e.g., illustrative antenna locations 50 of FIG. 1). Display 14 may contain an active area with an array of pixels (e.g., a central rectangular portion). Inactive areas of display 14 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 50 of FIG. 1 and/or in corner locations on the rear of housing 12), along the peripheral edges of housing 12, on the rear of housing 12, under the display cover glass or other dielectric display cover layer that is used in covering and protecting display 14 on the front of device 10, under a dielectric window on a rear face of housing 12 or the edge of housing 12, or elsewhere in device 10.

Figure 2:
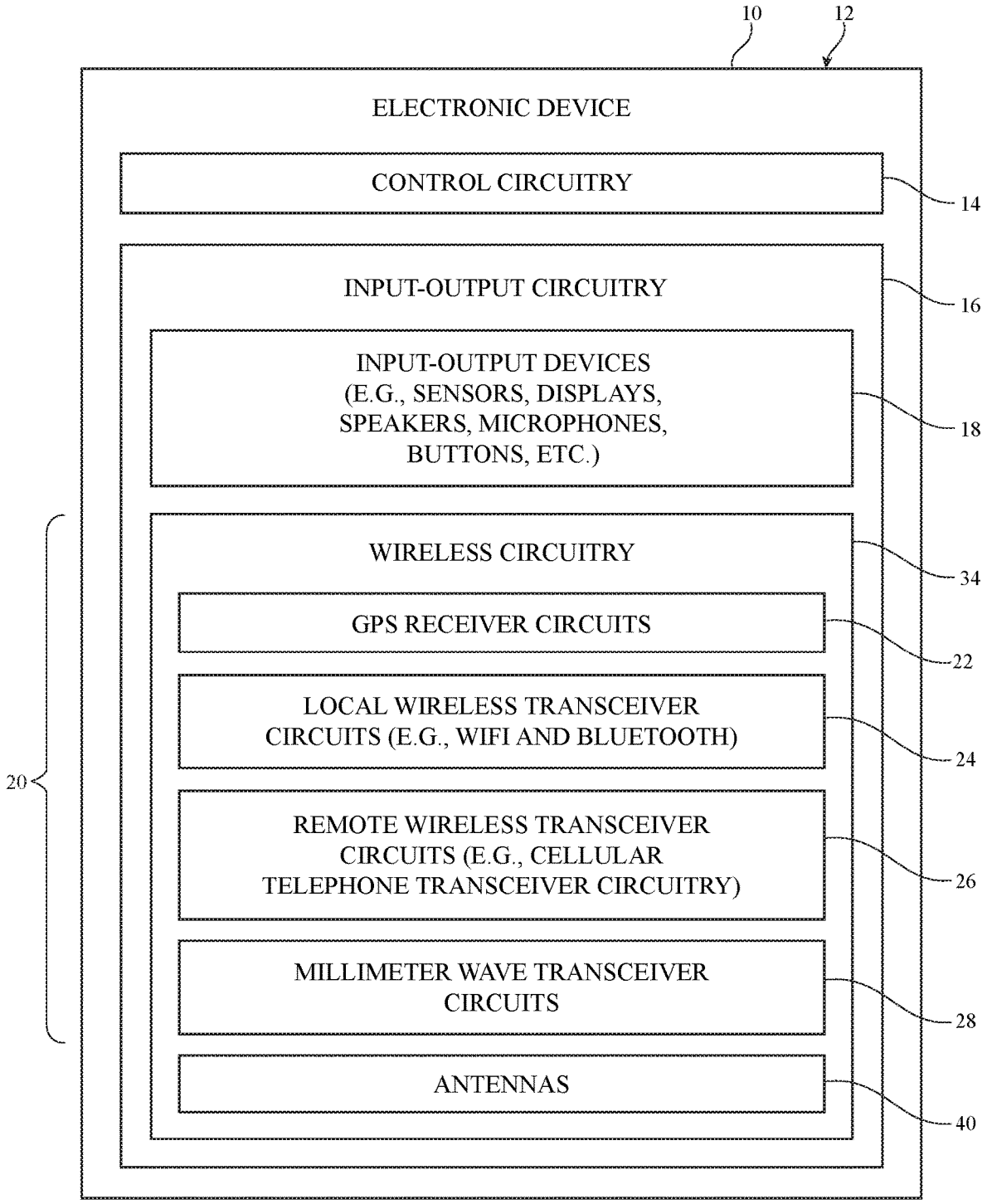
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network (WLAN) transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a communications band from 700 to 960 MHz, a communications band from 1710 to 2170 MHz, and a communications from 2300 to 2700 MHz or other communications bands between 700 MHz and 4000 MHz or other suitable frequencies (as examples). Circuitry 26 may handle voice data and non-voice data.

Millimeter wave transceiver circuitry 28 (sometimes referred to as extremely high frequency transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or $5^{th}$ generation mobile networks or $5^{th}$ generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals over these short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 may include one or more antennas such as antennas arranged in one or more phased antenna arrays for handling millimeter and centimeter wave communications.

Transmission line paths may be used to route antenna signals within device 10. For example, transmission line paths may be used to couple antenna structures 40 to transceiver circuitry 20. Transmission lines in device 10 may include coaxial cable paths, microstrip transmission lines, stripline transmission lines, edge-coupled microstrip transmission lines, edge-coupled stripline transmission lines, waveguide structures, coplanar waveguides, grounded coplanar waveguides, transmission lines formed from combinations of transmission lines of these types, etc. Filter circuitry, switching circuitry, impedance matching circuitry, and other circuitry may be interposed within the transmission lines, if desired.

In devices such as handheld devices, the presence of an external object such as the hand of a user or a table or other surface on which a device is resting has a potential to block wireless signals such as millimeter wave signals. Accordingly, it may be desirable to incorporate multiple antennas or phased antenna arrays into device 10, each of which is placed in a different location within device 10. With this type of arrangement, an unblocked antenna or phased antenna array may be switched into use. In scenarios where a phased antenna array is formed in device 10, once switched into use, the phased antenna array may use beam steering to optimize wireless performance. Configurations in which antennas from one or more different locations in device 10 are operated together may also be used.

Figure 3:
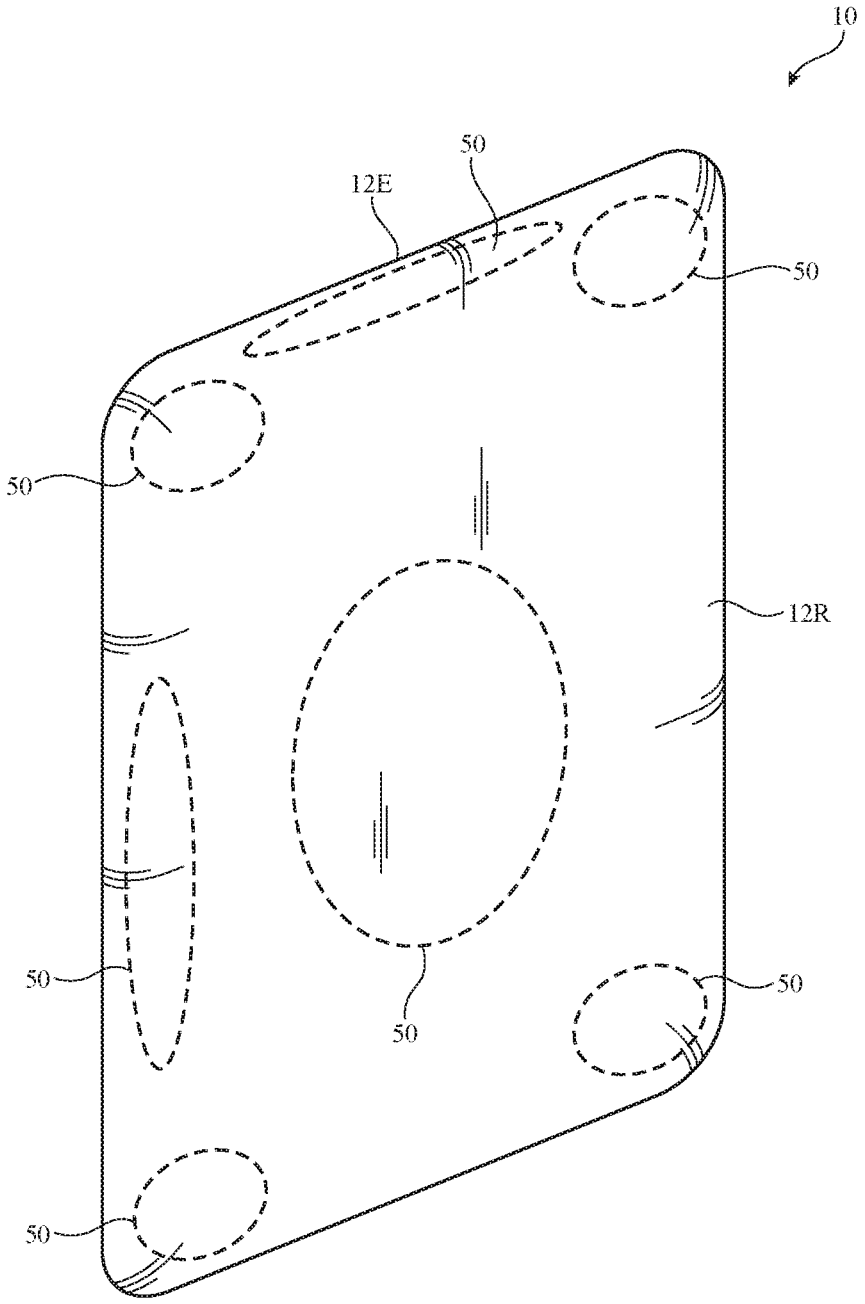
FIG. 3 is a rear perspective view of an illustrative electronic device showing illustrative locations at which antennas for communications at frequencies greater than 10 GHz may be located in accordance with an embodiment.

FIG. 3 is a perspective view of electronic device 10 showing illustrative locations 50 on the rear of housing 12 in which antennas 40 (e.g., single antennas and/or phased antenna arrays for use with wireless circuitry 34 such as transceiver circuitry 28) may be mounted in device 10. Antennas 40 may be mounted at the corners of device 10, along the edges of housing 12 such as edge 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment. In another suitable arrangement, antennas 40 may be mounted on the exterior of conductive portions of housing 12.

In devices with phased antenna arrays, circuitry 34 may include gain and phase adjustment circuitry that is used in adjusting the signals associated with each antenna 40 in an array (e.g., to perform beam steering). Switching circuitry may be used to switch desired antennas 40 into and out of use. If desired, each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
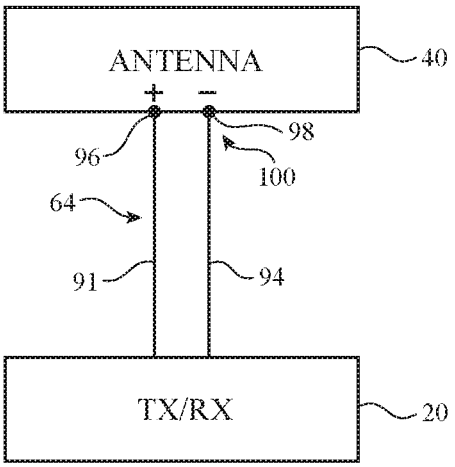
FIG. 4 is a diagram of an illustrative transceiver circuit and antenna in accordance with an embodiment.

A schematic diagram of a millimeter wave antenna or other antenna 40 coupled to transceiver circuitry 20 (e.g., transceiver circuitry 28 and/or other transceiver circuitry 20) is shown in FIG. 4. As shown in FIG. 4, radio-frequency transceiver circuitry 20 may be coupled to antenna feed 100 of antenna 40 using transmission line 64. Antenna feed 100 may include a positive antenna feed terminal such as positive antenna feed terminal 96 and may include a ground antenna feed terminal such as ground antenna feed terminal 98. Transmission line 64 may be formed form metal traces on a printed circuit or other conductive structures and may have a positive transmission line signal path such as path 91 that is coupled to terminal 96 and a ground transmission line signal path such as path 94 that is coupled to terminal 98. Transmission line paths such as path 64 may be used to route antenna signals within device 10. For example, transmission line paths may be used to couple antenna structures such as one or more antennas in an array of antennas to transceiver circuitry 20. Transmission lines in device 10 may include coaxial cable paths, microstrip transmission lines, stripline transmission lines, edge-coupled microstrip transmission lines, edge-coupled stripline transmission lines, waveguide structures, coplanar waveguides, grounded coplanar waveguides, transmission lines formed from combinations of transmission lines of these types, etc. Filter circuitry, switching circuitry, impedance matching circuitry, and other circuitry may be interposed within transmission line 64 and/or circuits such as these may be incorporated into antenna 40 if desired (e.g., to support antenna tuning, to support operation in desired frequency bands, etc.).

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may be arranged in one or more antenna arrays (e.g., phased antenna arrays to implement beam steering functions). For example, the antennas that are used in handling millimeter and centimeter wave signals for transceiver circuits 28 may be implemented as phased antenna arrays. The radiating elements in a phased antenna array for supporting millimeter and centimeter wave communications may be patch antennas, dipole antennas, dipole antennas with directors and reflectors in addition to dipole antenna resonating elements (sometimes referred to as Yagi antennas or beam antennas), or other suitable antenna elements. Transceiver circuitry can be integrated with the phased antenna arrays to form integrated phased antenna array and transceiver circuit modules (sometimes referred to herein as integrated antenna modules or integrated antenna and transceiver modules).

Figure 5:
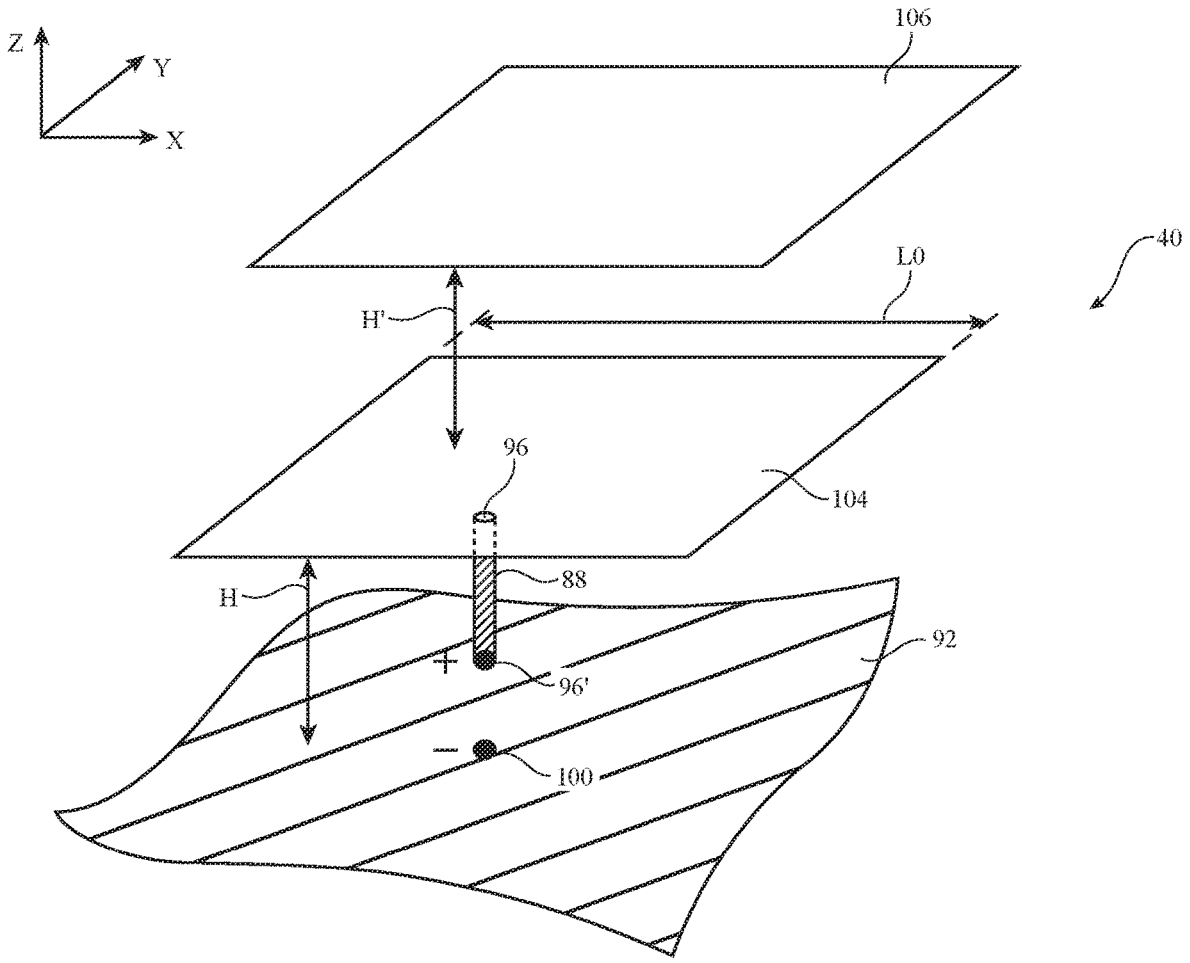
FIG. 5 is a perspective view of an illustrative patch antenna in accordance with an embodiment.

An illustrative patch antenna that may be used in conveying signals at frequencies greater than 10 GHz such as millimeter wave signals is shown in FIG. 5. As shown in FIG. 5, patch antenna 40 may have a patch antenna resonating element 104 that is separated from and parallel to a ground plane such as antenna ground plane 92. Positive antenna feed terminal 96 may be coupled to patch antenna resonating element 104. Ground antenna feed terminal 98 may be coupled to ground plane 92. If desired, conductive path 88 may be used to couple terminal 96' to terminal 96 so that antenna 40 is fed using a transmission line with a positive conductor coupled to terminal 96' and thus terminal 96. If desired, path 88 may be omitted. Other types of antenna feed arrangements may be used if desired. The illustrative feeding configuration of FIG. 5 is merely illustrative.

As shown in FIG. 5, patch antenna resonating element 104 may lie within a plane such as the X-Y plane of FIG. 5 (e.g., the lateral surface area of element 104 may lie in the X-Y plane). Patch antenna resonating element 104 may sometimes be referred to herein as patch 104, patch element 104, patch resonating element 104, antenna resonating element 104, or resonating element 104. Ground 92 may lie within a plane that is parallel to the plane of patch 104. Patch 104 and ground 92 may therefore lie in separate parallel planes that are separated by a distance H. Patch 104 and ground 92 may be formed from conductive traces patterned on a dielectric substrate such as a rigid or flexible printed circuit board substrate, metal foil, stamped sheet metal, electronic device housing structures, or any other desired conductive structures. The length of the sides of patch 104 may be selected so that antenna 40 resonates at a desired operating frequency. For example, the sides of element 104 may each have a length L0 that is approximately equal to half of the wavelength (e.g., within 15% of half of the wavelength) of the signals conveyed by antenna 40 (e.g., in scenarios where patch element 104 is substantially square).

If desired, antenna 40 may include a parasitic antenna resonating element such as parasitic antenna resonating element 106. Parasitic antenna resonating element 106 may have a lateral surface area extending in the X-Y plane of FIG. 5 and may be separated from patch element 104 by distance H'. Parasitic antenna resonating element 106 may have any desired shape (e.g., a rectangular shape, square shape, polygonal shape, or other shapes having curved and/or straight edges). If desired, parasitic antenna resonating element 106 may have a cross-shape in which element 106 includes three or more conductive arms extending from a common point along at least two different non-parallel longitudinal axes. Parasitic antenna resonating element 106 may be formed from conductive traces patterned onto a dielectric substrate, from stamped sheet metal, metal foil, electronic device housing structures, or any other desired conductive structures. Parasitic antenna resonating element 106 may sometimes be referred to herein as parasitic resonating element 106, parasitic antenna element 106, parasitic element 106, parasitic patch 106, parasitic conductor 106, parasitic structure 106, patch 106, or parasitic 106. Parasitic element 106 may have edges that are aligned with (e.g., extend parallel to) one or more sides of patch 104 or may be rotated with respect to patch 104 if desired.

Parasitic element 106 is not directly fed (e.g., element 106 is not electrically connected to any transmission lines 64), whereas patch antenna resonating element 104 is directly fed via transmission line 64 and feed terminal 96. Parasitic element 106 may create a constructive perturbation of the electromagnetic field generated by patch antenna resonating element 104, creating a new resonance for antenna 40. This may serve to broaden the overall bandwidth of antenna 40 (e.g., to cover an entire millimeter wave frequency band from 57 GHz to 71 GHz).

The example of FIG. 5 is merely illustrative. Patch 104 may have a square shape in which all of the sides of patch 104 are the same length or may have a different rectangular shape. If desired, patch 104 and ground 92 may have different shapes and orientations (e.g., planar shapes, curved patch shapes, patch shapes with non-rectangular outlines, shapes with straight edges such as squares, shapes with curved edges such as ovals and circles, shapes with combinations of curved and straight edges, etc.). In scenarios where patch 104 is non-rectangular, patch 104 may have a side or a maximum lateral dimension that is approximately equal to (e.g., within 15% of) half of the wavelength of operation, for example. If desired, parasitic element 106 may be omitted.

Figure 6:
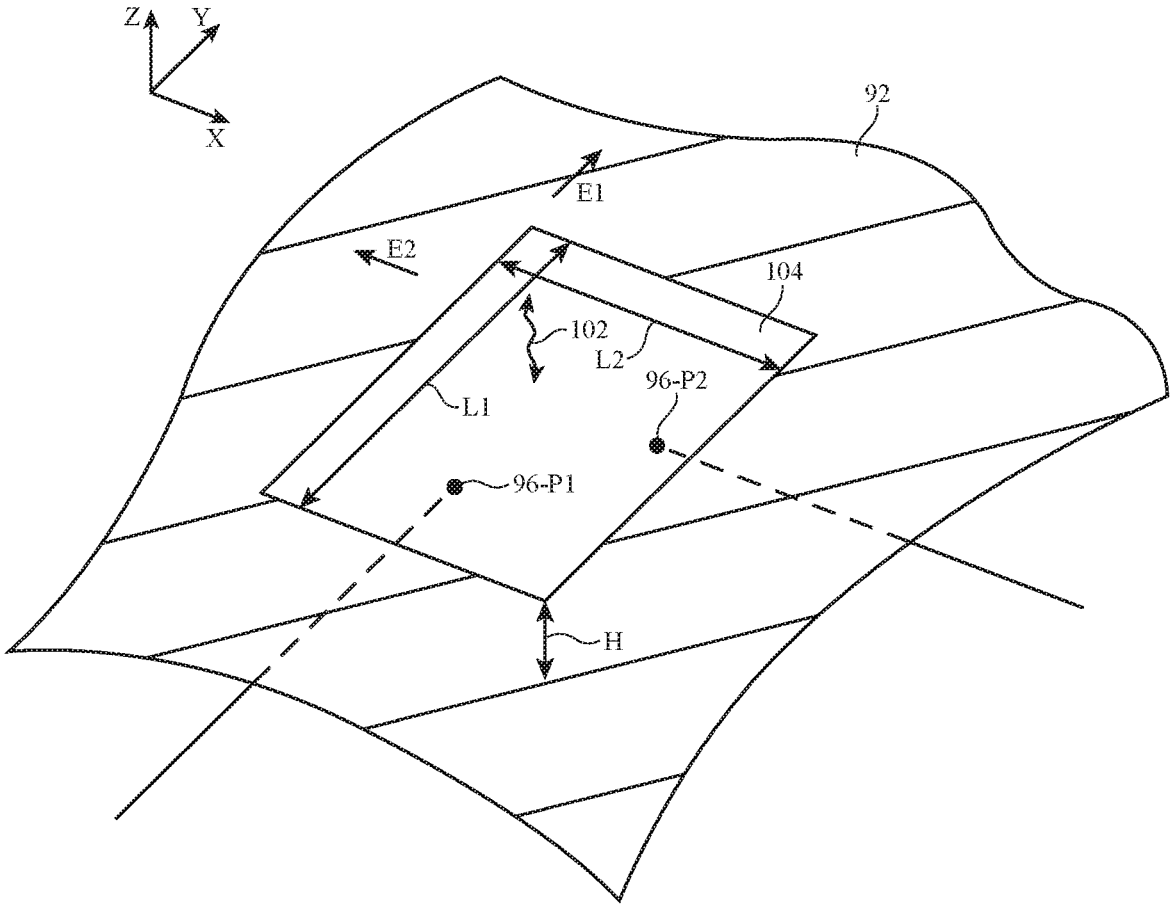
FIG. 6 is a perspective view of an illustrative patch antenna with dual ports in accordance with an embodiment.

To enhance the polarizations handled by patch antenna 40, antenna 40 may be provided with multiple feeds. An illustrative patch antenna with multiple feeds is shown in FIG. 6. As shown in FIG. 6, antenna 40 may have a first feed at antenna port P1 that is coupled to transmission line 64-1 and a second feed at antenna port P2 that is coupled to transmission line 64-2. The first antenna feed may have a first ground feed terminal coupled to ground 92 and a first positive feed terminal 96-P1 coupled to patch 104. The second antenna feed may have a second ground feed terminal coupled to ground 92 and a second positive feed terminal 96-P2 on patch 104.

Patch 104 may have a rectangular shape with a first pair of edges running parallel to dimension Y and a second pair of perpendicular edges running parallel to dimension X, for example. The length of patch 104 in dimension Y is L1 and the length of patch 104 in dimension X is L2. With this configuration, antenna 40 may be characterized by orthogonal polarizations.

When using the first antenna feed associated with port P1, antenna 40 may transmit and/or receive antenna signals in a first communications band at a first frequency (e.g., a frequency at which one-half of the corresponding wavelength is approximately equal to dimension L1). These signals may have a first polarization (e.g., the electric field E1 of antenna signals 102 associated with port P1 may be oriented parallel to dimension Y). When using the antenna feed associated with port P2, antenna 40 may transmit and/or receive antenna signals in a second communications band at a second frequency (e.g., a frequency at which one-half of the corresponding wavelength is approximately equal to dimension L2). These signals may have a second polarization (e.g., the electric field E2 of antenna signals 102 associated with port P2 may be oriented parallel to dimension X so that the polarizations associated with ports P1 and P2 are orthogonal to each other). In scenarios where patch 104 is square (e.g., length L1 is equal to length L2), ports P1 and P2 may cover the same communications band. In scenarios where patch 104 is rectangular, ports P1 and P2 may cover different communications bands if desired. During wireless communications using device 10, device 10 may use port P1, port P2, or both port P1 and P2 to transmit and/or receive signals (e.g., millimeter wave signals).

The example of FIG. 6 is merely illustrative. Patch 104 may have a square shape in which all of the sides of patch 104 are the same length or may have a rectangular shape in which length L1 is different from length L2. In general, patch 104 and ground 92 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.). If desired, the dual-polarization patch antenna as shown in FIG. 6 may be provided with a parasitic antenna resonating element such as element 106 of FIG. 5 (e.g., to widen the bandwidth of antenna 40).

Antennas 40 such as single-polarization patch antennas of the type shown in FIG. 5 and/or dual-polarization patch antennas of the type shown in FIG. 6 may be arranged within a corresponding phased antenna array in device 10. If desired, one or more antennas 40 may be integrated with other circuitry such as transceiver circuitry 20 to form an integrated antenna module.

Figure 7:
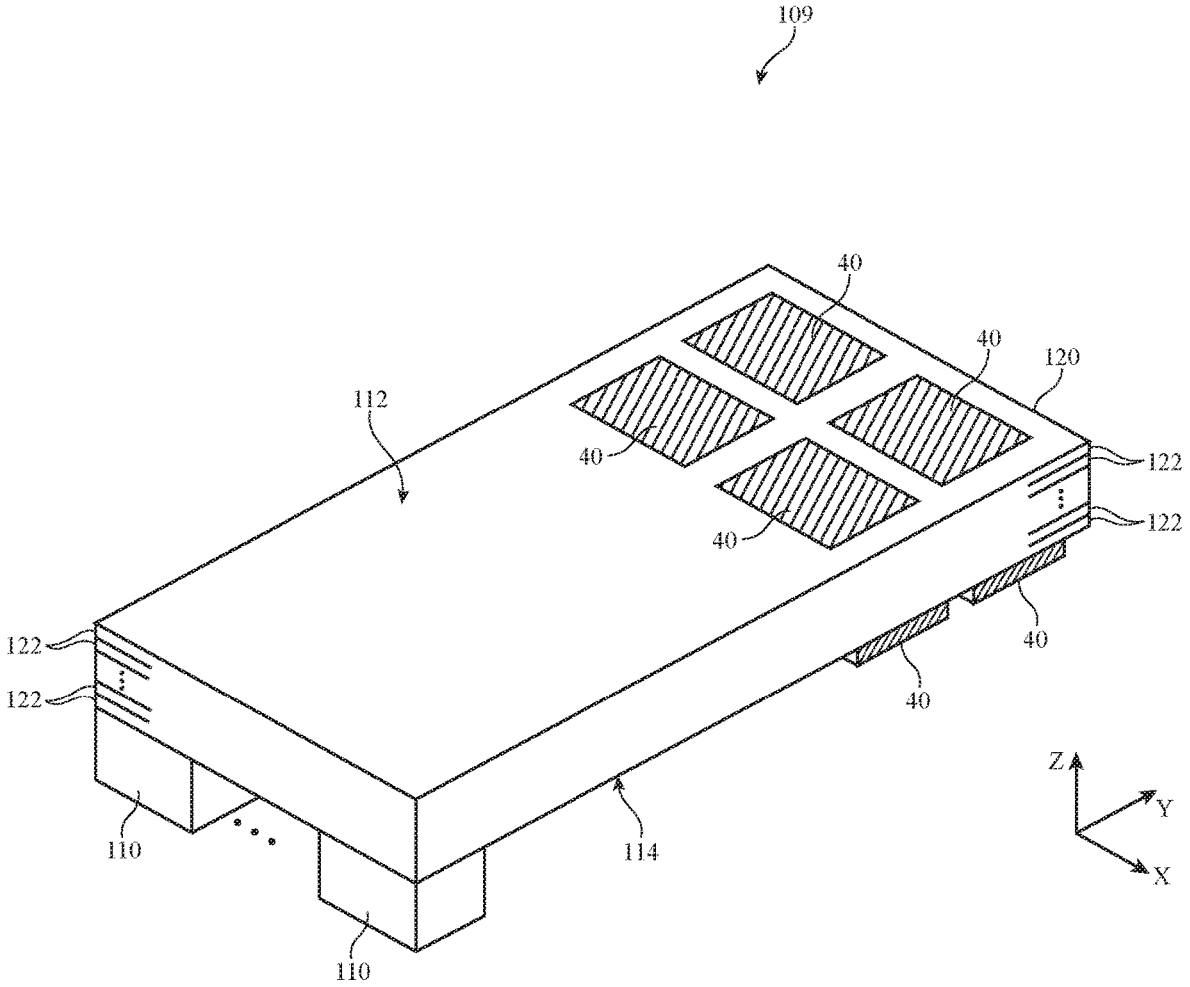
FIG. 7 is a perspective view of an illustrative integrated antenna module in accordance with an embodiment.

FIG. 7 is a perspective view of an illustrative integrated antenna module for handling signals at frequencies greater than 10 GHz in device 10 (e.g., millimeter wave signals). As shown in FIG. 7, device 10 may be provided with an integrated antenna module such as module 109. Module 109 may include one or more antennas 40 (e.g., single-polarization patch antennas of the type shown in FIG. 5 and/or dual-polarization patch antennas of the type shown in FIG. 6) formed on a dielectric substrate such as dielectric substrate 120. Substrate 120 may be, for example, a rigid or printed circuit board or other dielectric substrate. Substrate 120 may be a stacked dielectric substrate that includes multiple stacked dielectric layers 122 (e.g., multiple layers of printed circuit board substrate such as multiple layers of fiberglass-filled epoxy, rigid printed circuit board material, flexible printed circuit board material, ceramic, plastic, glass, or other dielectrics).

Any desired number of antennas 40 may be formed on substrate 120 (e.g., one antenna 40, two or more antennas 40 arranged in one or more phased antenna arrays, etc.). Antennas 40 may be formed adjacent to front side 112 and/or rear side 114 of substrate 120 (e.g., at the surface of substrate 120 or embedded within layers 122 adjacent to sides 112 or 114). There may be, for example, a square array of four elements 40 at front side 112 of substrate 120 and/or a square array of four elements 40 at rear side 114 of substrate 120. The antennas 40 at front side 112 may, for example, form a first phased antenna array whereas the antennas 40 at rear side 114 may, for example, form a second phased antenna array.

The use of a phased array of elements 40 allows the signals of antennas 40 to be steered using beam steering techniques. This is merely illustrative. In general, one or more antennas 40 may be formed on one or both of sides 112 and 114 and may be arranged in any desired pattern (e.g., antennas 40 need not be arranged in a phased antenna array). Antennas 40 may include elements such as patch antenna resonating elements 104, antenna ground plane elements 92, and/or parasitic antenna resonating elements 106 that are interposed between or formed on layers 122 of substrate 120. One or more electrical components 110 (e.g., transceiver circuitry such as circuitry 20, circuitry 28, etc.) may be mounted on substrate 120 (e.g., on rear surface 114). Components 110 may be mounted to the same layer 122 as one or more antennas 40 or may be mounted to other layers 122 in substrate 120. Components 110 may be mounted to the surface of substrate 120 at side 114, for example. Components 110 may, for example, include integrated circuits (e.g., integrated circuit chips) or integrated circuit packages mounted to substrate 120. Components 110 may sometimes be referred to herein as transceivers 110, transceiver circuitry 110, or transceiver chips 110. If desired, components 110 may include control circuitry (e.g., some or all of circuitry 14 of FIG. 2) or any other desired electrical components.

The example of FIG. 7 is merely illustrative. In general, any desired number of antennas 40 may be formed adjacent to sides 112 and/or 114 or at other locations within the layers 122 of substrate 120. For example, zero, one, two, or more than two antennas 40 may be formed adjacent to front side 112. Similarly, zero, one, two, or more than two antennas 40 may be formed adjacent to rear side 114. Substrate 120 may have any desired shape and may be flexible, rigid, or may include flexible and rigid portions.

Conductive traces or other metal layers that are used in forming transmission line structures such as transmission lines 64 of FIG. 4 may be interposed between layers 122 of substrate 120. The transmission lines may be used to convey signals at frequencies greater than 10 GHz such as millimeter wave signals between transceiver 110 and antennas 40. For example, a respective transmission line may be coupled between each antenna 40 in module 109 and one or more transceivers 110. In scenarios where antennas 40 include multiple feeds (e.g., as shown in FIG. 6), a respective transmission line may be coupled between each antenna feed in module 109 and transceivers 110. As the number of antennas 40 and antenna feeds 100 implemented in module 109 increases, the routing complexity of the corresponding transmission lines may increase. If care is not taken, it can be difficult to ensure that each of the transmission lines in module 109 is sufficiently isolated from the other transmission lines in module 109.

Figure 8:
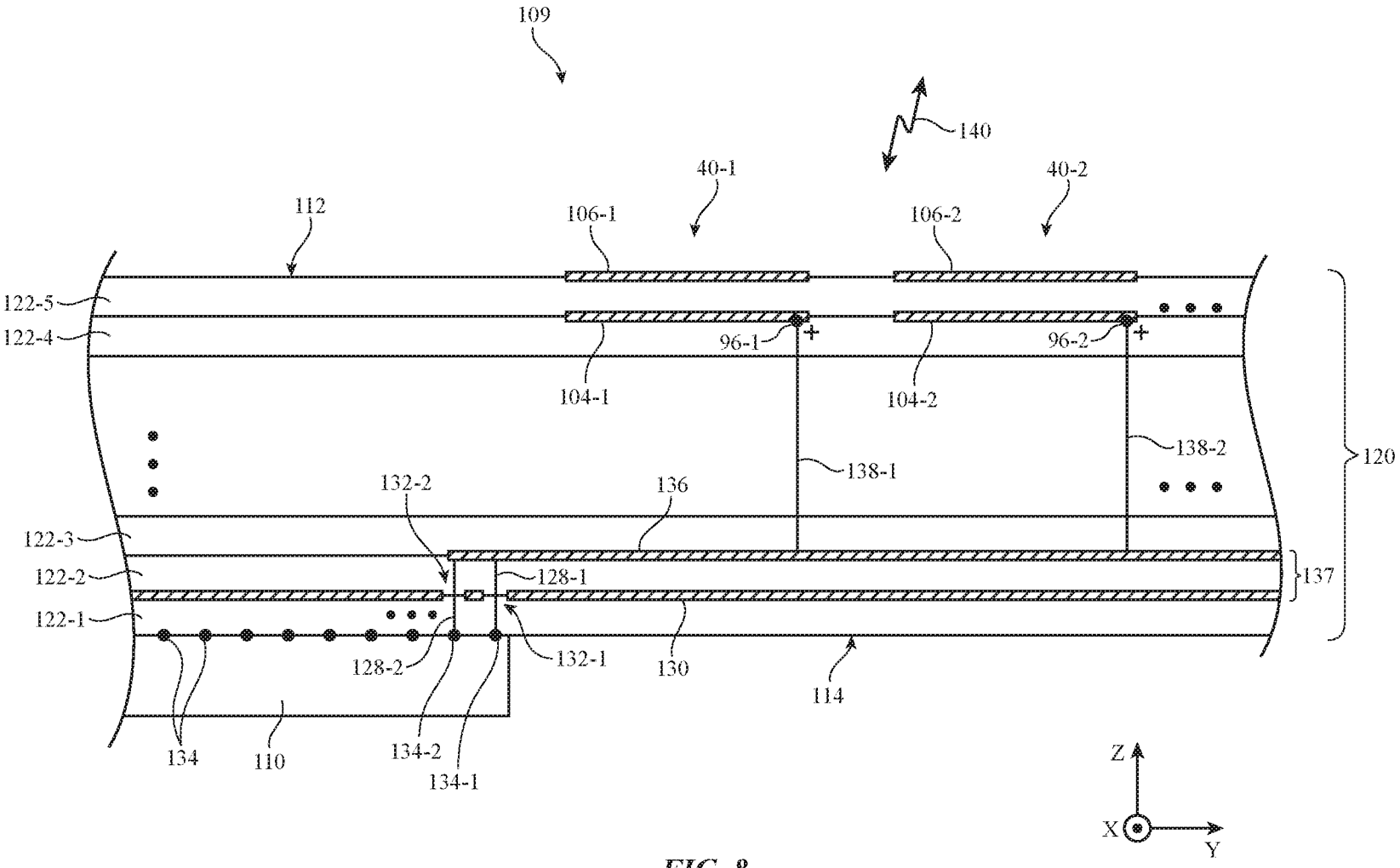
FIG. 8 is a cross-sectional side view of an illustrative integrated antenna module having antenna resonating elements at a first side of a stacked dielectric substrate in accordance with an embodiment.

FIG. 8 is a cross-sectional side view of integrated antenna module 109 (e.g., as taken in the Y-Z plane of FIG. 7) having antennas 40 formed adjacent to a single side of module 109. As shown in FIG. 8, integrated antenna module 109 may include multiple antennas such as a first antenna 40-1 and a second antenna 40-2 adjacent to side 112 of module 109. Substrate 120 may include multiple dielectric layers such as a first layer 122-1, a second layer 122-2 over the first layer, a third layer 122-3 over the second layer, a fourth layer 122-4 over the third layer, and a fifth layer 122-5 over the fourth layer. Additional dielectric layers 122 may be stacked within substrate 120 if desired.

With this type of arrangement, antennas 40-1 and 40-2 may be embedded within the layers of substrate 120. For example, first antenna 40-1 may include a first antenna resonating element 104-1 formed on layer 122-4 and second antenna 40-2 may include a second antenna resonating element 104-2 formed on layer 122-4. If desired, antenna 40-1 may include a parasitic element 106 such as parasitic 106-1 formed on layer 122-5 and antenna 40-2 may include a parasitic element 106 such as parasitic 106-2 formed on layer 122-5.

Grounded conductive traces 130 may be formed on layer 122-1. Grounded conductive traces 130 may form antenna ground plane 92 for antennas 40-1 and 40-2 (e.g., resonating elements 104-1 and 104-2 may be formed at distance H from traces 130 as shown in FIGS. 5 and 6). A transceiver 110 may be formed at side 114 of substrate 120. Transceiver 110 may include, for example, an integrated circuit or integrated circuit package mounted to side 114 of substrate 120. Transceiver 110 may include transceiver ports 134 such as a first port 134-1 and a second port 134-2. Each port 134 may be used to convey signals (e.g., millimeter wave signals) for a corresponding antenna 40. Ports 134 may include conductive contact pads, solder balls, microbumps, conductive pins, conductive pillars, conductive sockets, conductive clips, welds, conductive adhesive, conductive wires, interface circuits, or any other desired conductive interconnect structures.

Conductive traces 136 may be formed on dielectric layer 122-2. Conductive traces 136 and conductive traces 130 may form transmission line structures 137 for antennas 40 (e.g., one or more transmission lines 64 as shown in FIG. 4). Transmission line structures 137 may, for example, included coplanar waveguide structures for conveying millimeter wave signals between transceiver ports 134 and antennas 40.

Conductive traces 136 may include signal portions (sometimes referred to herein as signal conductors) and grounded portions (sometimes referred to herein as ground conductors). Each signal conductor in traces 136 may be coupled to a corresponding feed terminal 96 on antennas 40 via a corresponding vertical conductive structure 138 (e.g., traces 136 may include at least one signal conductor for each antenna 40 formed on module 109). Each signal conductor in traces 136 may be coupled to a respective port 134 on transceiver 110 via a corresponding vertical conductive structure 128. Vertical conductive structures 138 and 128 may include conductive through-vias, metal pillars, metal wires, conductive pins, or any other desired vertical conductive interconnects. One or more holes or openings 132 may be formed in ground traces 130 for accommodating vertical conductors 128.

The ground conductors within traces 136 may be laterally interposed (e.g., in the X-Y plane) between the signal conductors and may serve to electromagnetically isolate each signal conductor from the other signal conductors in traces 136. The signal and ground conductors in traces 136 may, for example, be configured to form coplanar waveguide transmission lines for each antenna 40. If desired, the ground conductors in traces 136 may be shorted to ground traces 130. In this scenario, the signal and ground conductors in traces 136 and ground traces 130 may be configured to form grounded coplanar waveguide transmission lines for each antenna 130.

In the example of FIG. 8, traces 136 may include a first signal conductor coupled to port 134-1 over vertical conductive structure 132-1. The first signal conductor may be coupled to feed terminal 96-1 on antenna resonating element 104-1 of antenna 40-1 over vertical conductive structure 138-1. Vertical conductor 132-1 may extend from traces 136 through layer 122-2, opening 132-1 in ground traces 130, and layer 122-1 to first port 134-1. Vertical conductor 138-1 may extend from traces 136 through layers 122-3 and 122-4 to feed terminal 96-1.

Similarly, traces 136 may include a second signal conductor coupled to port 134-2 over vertical conductive structure 132-2. The second signal conductor may be coupled to feed terminal 96-2 on antenna resonating element 104-2 of antenna 40-2 over vertical conductive structure 138-2. Vertical conductor 132-2 may extend from traces 136 through layer 122-2, opening 132-1 in ground traces 130, and layer 122-1 to second port 134-2. Vertical conductor 138-2 may extend from traces 136 through layers 122-3 and 122-4 to feed terminal 96-2. The first and second signal conductors in traces 136 may each be laterally interposed between two corresponding ground conductors in traces 136 that serve to isolate the signal conductors from each other.

When configured in this way, the first signal conductor and two of the ground conductors in traces 136 may form a first transmission line 64 (e.g., a first coplanar waveguide) that conveys signals at frequencies above 10 GHz between port 134-1 and antenna 40-1 whereas the second signal conductor and two of the ground conductors in traces 136 form a second transmission line (e.g., a second coplanar waveguide) that conveys signals between port 134-2 and antenna 40-2. If desired, the ground conductors in traces 136 may be shorted to ground traces 130 to form first and second grounded coplanar wave guide transmission lines for conveying signals between ports 134 and antennas 40. When configured in this way, antennas 40 adjacent to side 112 of module 109 such as antennas 40-1 and 40-2 may convey signals over a first hemisphere above side 112 (e.g., as shown by arrow 140). Antennas 40-1 and 40-2 may, for example, be elements in a phased antenna array that performs beam steering over the hemisphere above side 112 of module 109.

The example of FIG. 8 is merely illustrative. If desired, additional layers 122 may be interposed between resonating elements 104 and parasitic elements 106, between traces 136 and 130, and/or between traces 130 and transceiver 110. Fewer or additional layers 122 may be interposed between resonating elements 104 and traces 136. One or more additional layers 122 may be formed over parasitic elements 106 and/or under transceiver 110 if desired (e.g., transceiver 110 may be formed within a cavity defined by two layers 122 in substrate 120). Parasitic elements 106 may be omitted if desired. Antenna resonating elements 104 may all be formed on the same dielectric layer (e.g., layer 122-4) or two or more resonating elements 104 may be formed on different dielectric layers. In yet another suitable arrangement, substrate 120 may be omitted and antennas 40-1 and 40-2 may be formed on other substrate structures or may be formed without substrates.

The example of FIG. 8 in which two antennas 40-1 and 40-2 are formed adjacent to side 112 is merely illustrative. In general, any desired number of antennas 40 may be formed adjacent to side 112 and fed using corresponding coplanar waveguides (e.g., grounded coplanar waveguides) formed from structures 137. In the example of FIG. 8, antennas 40-1 and 40-2 are each shown as only having a single feed for the sake of simplicity. In order to enhance the polarizations covered by antennas 40, antennas 40-1 and 40-2 may include two feeds such as shown in FIG. 6.

In this scenario, structures 137 may include respective coplanar waveguides (e.g., traces 136 may include respective signal conductors) for each antenna feed terminal 96 that is used. For example, each feed terminal 96 of antenna 40-1 may be coupled to a different corresponding signal conductor within traces 136 and to a different corresponding transceiver port 134. Similarly, each feed terminal 96 of antenna 40-2 may be coupled to a different corresponding signal conductor within traces 136 and to a different corresponding transceiver port 134 (e.g., antennas 40-1 and 40-2 may have a combined total of four antenna feeds that are fed using four respective coplanar waveguides formed using structures 137 and four different transceiver ports 134). The ground conductors within traces 136 and ground traces 130 may serve to shield side 114 of module 109 from signals conveyed by antennas 40-1 and 40-2. At the same time, the ground conductors within traces 136 and ground traces 130 may serve to isolate each signal conductor in traces 136 from the other signal conductors in traces 136, thereby minimizing electromagnetic coupling between the signals conveyed by each port 134 of transceiver 110, for example.

Figure 9:
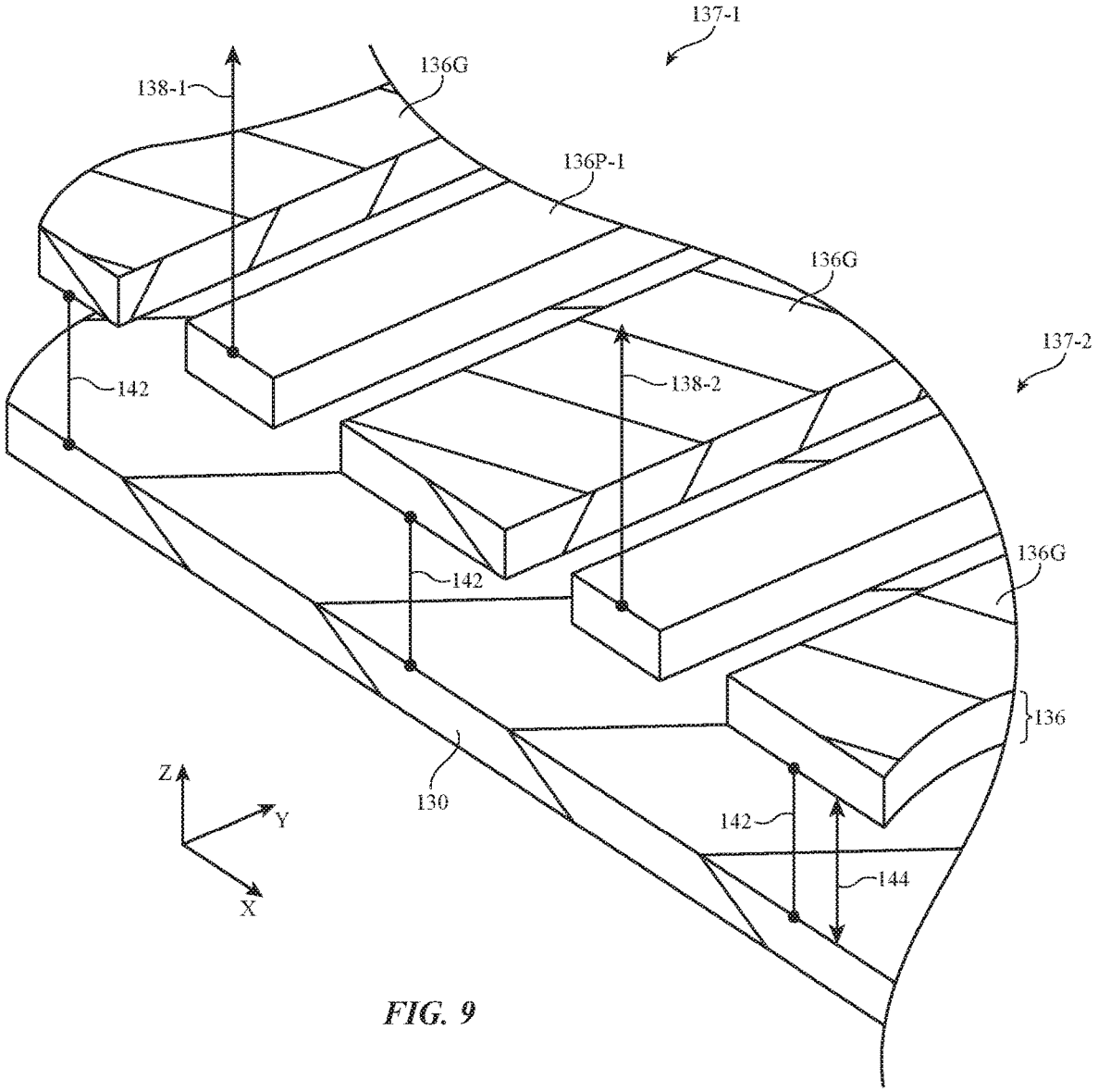
FIG. 9 is a perspective view of illustrative transmission line structures that may be used to convey millimeter wave signals for an integrated antenna module of the type shown in FIG. 8 in accordance with an embodiment.

FIG. 9 is a perspective view of transmission line structures 137 for antennas 40-1 and 40-2. In the example of FIG. 9, dielectric layers 122 are not shown for the sake of clarity. As shown in FIG. 9, conductive traces 136 may be formed at distance 144 from ground traces 130 (e.g., the thickness of layer 122-2 of FIG. 8 may be equal to distance 144).

Conductive traces 136 may include grounded portions 136G that are sometimes referred to herein as ground conductors, ground traces, or ground portions. Conductive traces 136 may include signal-level portions 136P that are sometimes referred to herein as signal conductors, signal traces, or micro strips. Signal conductors 136P may be laterally interposed between two ground conductors 136G. Signal conductors 136P may be separated from the two adjacent ground conductors 136G by gaps or openings that are free from conductive material.

If desired, ground conductors 136G may be shorted to ground traces 130 over vertical conductive structures 142. Vertical conductive structures 142 may include conductive through-vias, metal pillars, metal wires, conductive pins, or any other desired vertical conductive interconnect structures. Ground traces 136G and 130 may be held at a ground or reference potential, for example. Ground traces 136G and/or 130 may, if desired, be shorted to one or more dedicated ground ports 134 on transceiver 110 (FIG. 8).

Each signal conductor 136P may be coupled to a respective signal port 134 on transceiver 110 and to a respective antenna feed terminal 96 on a corresponding antenna 40. In the example of FIG. 9, traces 136 include a first signal conductor 136P-1 coupled to port 134-1 on transceiver 110 over vertical conductor 128-1 and coupled to feed terminal 96-1 on antenna 40-1 over vertical conductor 138-1 (FIG. 8). Traces 136 include a second signal conductor 136P-2 be coupled to port 134-2 over vertical conductor 128-2 and coupled to feed terminal 96-2 on antenna 40-2 over vertical conductor 138-2.

Signal conductor 136P-1 may convey antenna currents between transceiver port 134-1 and feed terminal 96-1 on antenna 40-1. Corresponding signals for antenna 40-1 may be conveyed down the longitudinal length of signal conductor 136P-1 (e.g., along the Y-axis of FIG. 9) between the ground conductors 136G adjacent to signal conductor 136P-1 and the underlying ground traces 130 (e.g., from vertical conductive structure 128-1 to vertical conductive structure 138-1 as shown in FIG. 8). Similarly, signal conductor 136P-2 may convey antenna currents between transceiver port 134-2 and feed terminal 96-2 on antenna 40-2. Corresponding signals for antenna 40-2 may be conveyed down the longitudinal length of signal conductor 136P-2 between the ground conductors 136G adjacent to signal conductor 136P-2 and the underlying ground traces 130 (e.g., from vertical conductive structure 128-2 to vertical conductive structure 138-2 as shown in FIG. 8).

In this way, transmission line structures 137 may be configured to include a first coplanar waveguide 137-1 formed from signal conductor 136P-1, the adjacent ground traces 136G, and the underlying ground traces 130 that conveys signals for first antenna 40-1 and a second coplanar waveguide 137-2 formed from signal conductor 136P-2, the adjacent ground traces 136G, and the underlying ground traces 130 that conveys signals for second antenna 40-2 (e.g., first coplanar waveguide 137-1 may form a first transmission line 64 for antenna 40-1 having a signal path 91 formed from conductor 136P-1 and ground path 94 formed from traces 136G and 130, whereas second coplanar waveguide 137-2 forms a second transmission line 64 for antenna 40-2 having a signal path 91 formed from conductor 136P-2 and ground path 94 formed from traces 136G and 130 as shown in FIG. 4). Transmission lines 137-1 and 137-2 may sometimes be referred to as grounded coplanar transmission lines in scenarios where vertical conductive structures 142 are formed between traces 136G and 130. Structures 142 may be omitted if desired.

When configured in this way, ground traces 136G and 130 may both serve as antenna ground 92 for antennas 40-1 and 40-2 (FIGS. 5 and 6). Ground traces 136G may serve to isolate signal conductor 136P-1 from the signals conveyed over coplanar waveguide 137-2 and to isolate signal conductor 136P-2 from the signals conveyed over coplanar waveguide 137-1. In this way, the signals at frequencies greater than 10 GHz such as millimeter wave signals conveyed over coplanar waveguide 137-1 may be electromagnetically decoupled from the signals conveyed over coplanar waveguide 137-2, thereby minimizing interference between antenna ports 134-1 and 134-2 and optimizing the wireless performance of antenna module 109, for example.

The example of FIG. 9 is merely illustrative. In general, layer 136 may include a different respective signal conductor 136P for each feed terminal 96 on antennas 40 that is used (e.g., structures 137 may include a different respective coplanar waveguide for each feed terminal that is used). For example, in scenarios where module 109 includes two antennas 40 each having two feeds (e.g., as shown in FIG. 6), traces 136 may include four signal conductors 136P, each separated from the other signal conductors 136P by at least one ground trace 136G. In general, any desired number of antennas 40 having any desired number of feeds may be provided at side 112 of module 109 (e.g., one antenna 40, two antennas 40, three antennas 40, four antennas 40, between four and eight antennas 40, between eight and sixteen antennas 40, more than sixteen antennas 40, etc.). While the transmission line structures shown in FIG. 9 may provide suitable electromagnetic decoupling for each antenna 40 when antennas 40 are formed at a single side 112 of substrate 120, if care is not taken, it can also be challenging to ensure transmission line isolation in scenarios where antennas 40 are formed at both sides of substrate 120.

Figure 10:
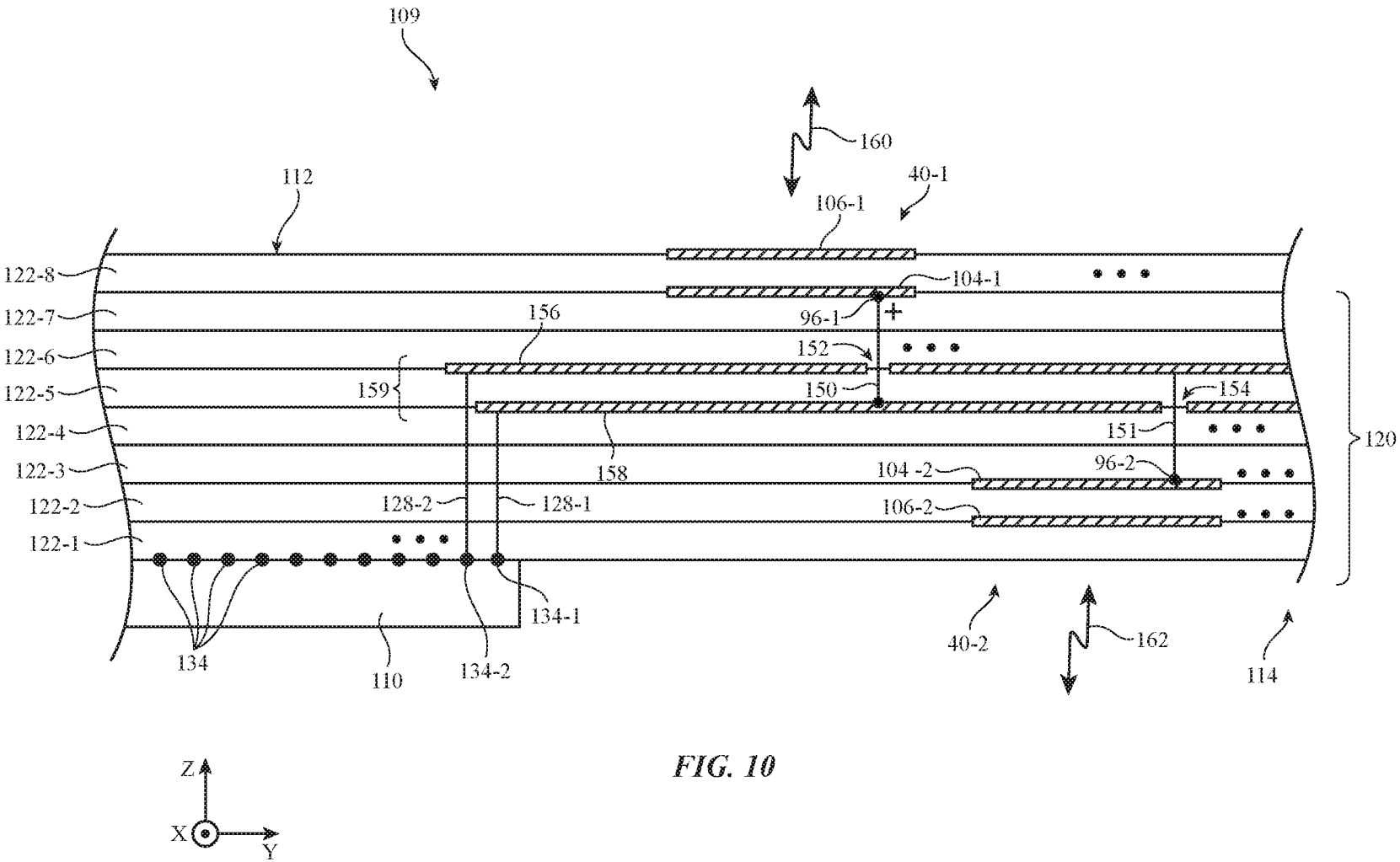
FIG. 10 is a cross-sectional side view of an illustrative integrated antenna module having antenna resonating elements at first and second sides of a stacked dielectric substrate in accordance with an embodiment.

FIG. 10 is a cross-sectional side view of antenna module 109 having antennas 40 formed adjacent to both sides of substrate 120. As shown in FIG. 10, substrate 120 may include dielectric layers such as first dielectric layer 122-1, second dielectric layer 122-2 over the first layer, third dielectric layer 122-3 over the second layer, fourth dielectric layer 122-4 over the third layer, fifth dielectric layer 122-5 over the fourth layer, sixth dielectric layer 122-6 over the fifth layer, seventh dielectric layer 122-7 over the sixth layer, and eighth dielectric layer 122-8 over the seventh dielectric layer.

Module 109 may include a first set of antennas 40 adjacent to side 112 and a second set of antennas 40 adjacent to side 114. In the example of FIG. 10, a first antenna 40-1 is provided adjacent to side 112 and a second antenna 40-2 is provided adjacent to side 114. Patch antenna resonating element 104-1 of antenna 40-1 may be formed on dielectric layer 122-7. If desired, antenna 40-1 may include a parasitic element 106-1 formed on layer 122-8. Patch antenna resonating element 104-2 of antenna 40-2 may be formed on dielectric layer 122-2. If desired, antenna 40-2 may include a parasitic element 106-2 formed on layer 122-1.

First conductive traces 156 may be formed on a surface of dielectric layer 122-5. Second conductive traces 158 may be formed on a surface of dielectric layer 122-4. Conductive traces 156 and 158 may form transmission line structures 159 (e.g., one or more transmission lines 64 of FIG. 4).

Transmission line structures 159 may, for example, include coplanar waveguide structures for both antennas adjacent to side 112 such as antenna 40-1 and antennas adjacent to side 114 such as antenna 40-2.

First conductive traces 156 may include two or more ground conductors and one or more signal conductors. The signal conductors in traces 156 may be coupled to ports 134 of transceiver 110 over corresponding vertical conductive structures 128 and may be coupled to feed terminals 96 on the antennas 40 adjacent to side 114 over corresponding vertical conductive structures 150. If desired, the ground conductors in traces 156 may be coupled to corresponding ports 134 of transceiver 110.

Second conductive traces 158 may include two or more ground conductors and one or more signal conductors. The signal conductors in traces 158 may be coupled to ports 134 of transceiver 110 over corresponding vertical conductive structures 128 and may be coupled to feed terminals 96 on the antennas 40 adjacent to side 112 over corresponding vertical conductive structures 152. If desired, the ground conductors in traces 156 may be shorted to the ground conductors in traces 158 (e.g., over one or more conductive through-vias). Openings such as opening 152 may be formed in traces 156. Openings such as opening 154 may be formed in traces 158. Openings 152 and 154 may sometimes be referred to herein as slots or gaps. Opening 152 may, for example, be formed between signal and ground conductors in traces 156. Opening 154 may, for example, be formed between signal and ground conductors in traces 158. Vertical conductive structures 150 may extend through opening 152 to feed terminals 96 on the antennas adjacent to side 112. Vertical conductive structures 151 may extend through opening 154 to feed terminals 96 on the antennas adjacent to side 114.

The ground conductors in traces 156 may form antenna ground 92 (FIGS. 5 and 6) for the antennas adjacent to side 112 whereas the ground conductors in traces 158 form antenna ground 92 for the antennas adjacent to side 114 of module 109. At the same time, the ground conductors in traces 156 may form part of one or more coplanar waveguides (e.g., grounded coplanar waveguides) that convey signals for the antennas adjacent to side 114 whereas the ground conductors in traces 158 form part of one or more coplanar waveguides (e.g., grounded coplanar waveguides) that convey signals for the antennas adjacent to side 112.

In the example of FIG. 10, conductive traces 156 may include a signal conductor that conveys signals at frequencies greater than 10 GHz (e.g., millimeter wave signals) for transceiver port 134-1. The signal conductor in conductive traces 156 may convey the signals to feed terminal 96-2 on antenna resonating element 104-2 of antenna 40-2 over vertical conductive structure 151 extending through opening 154 in traces 158. Traces 156 may include ground traces that form ground plane 92 for antenna 40-1 adjacent to side 112 and that form part of a coplanar waveguide that includes the signal conductor in traces 156. Conductive traces 158 may include a signal conductor that conveys signals at frequencies greater than 10 GHz (e.g., millimeter wave signals) for transceiver port 134-2. The signal conductor in conductive traces 158 may convey the signals to feed terminal 96-1 on antenna resonating element 104-1 of antenna 40-1 over vertical conductive structure 150 extending through opening 153 in traces 156. Traces 158 may include ground traces that form ground plane 92 for antenna 40-2 adjacent to side 114 and that form part of a grounded coplanar waveguide that includes the signal conductor in traces 158.

When configured in this way, antennas 40 adjacent to side 112 such as antenna 40-1 may convey signals over a first hemisphere above side 112 (e.g., as shown by arrow 160). Antennas 40 adjacent to side 114 such as antenna 40-2 may convey signals in a second hemisphere below side 114 (e.g., as shown by arrow 162). This may allow antennas 40 to perform communications cover all sides of module 109. Ground conductors in traces 156 and 158 may serve to electromagnetically isolate antennas 40 adjacent to side 112 from antennas 40 adjacent to side 114. In addition, forming transmission line structures 159 for antennas on two sides of module 109 using conductive traces 156 and 158 may minimize electromagnetic coupling between the signals conveyed by ports 134-1 and 134-2 of transceiver 110, for example.

The example of FIG. 10 is merely illustrative. If desired, additional layers 122 may be interposed between resonating element 104-2 and parasitic element 106-2, between parasitic 106-2 transceiver 110, between traces 158 and 156, and/or between resonating element 104-1 and parasitic 106-1. If desired, fewer or additional layers 122 may be formed between resonating element 104-1 and traces 156 and/or fewer or additional layers 122 may be formed between resonating element 104-2 and traces 158. Additional layers 122 may be formed over parasitic element 106-1 and/or under transceiver 110. In another suitable arrangement, substrate 120 may be formed from a single dielectric layer (e.g., antennas 40-1 and 40-2 may be embedded within a single dielectric layer such as a molded plastic layer). In yet another suitable arrangement, substrate 120 may be omitted and antennas 40-1 and 40-2 may be formed on other substrate structures or may be formed without substrates.

The example of FIG. 10 in which one antenna 40-1 is formed adjacent to side 112 and one antenna 40-2 is formed adjacent to side 114 is merely illustrative. In general, any desired number of antennas 40 may be formed at side 112 and/or side 114 of substrate 120 (e.g., each having corresponding signal conductors in traces 156 or 158 and transceiver ports 134). The antennas adjacent to side 112 may form a first phased antenna array for conveying signals 160 whereas the antennas adjacent to side 114 may form a second phased antenna array for conveying signals 162, if desired.

In the example of FIG. 10, antennas 40-1 and 40-2 are shown as only having a single feed for the sake of simplicity. In order to enhance the polarizations covered by antennas 40, antennas 40-1 and 40-2 may each include two feeds such as shown in FIG. 6. In this scenario, each feed terminal 96 of antenna 40-1 may be coupled to a different corresponding signal conductor within traces 158 and to a different corresponding transceiver port 134. Similarly, each feed terminal 96 of antenna 40-2 may be coupled to a different corresponding signal conductor within traces 156 and to a different corresponding transceiver port 134 (e.g., antennas 40-1 and 40-2 may have a combined total of four antenna feeds that are fed using four coplanar waveguides formed using structures 159 and four different transceiver ports 134).

Figure 11:
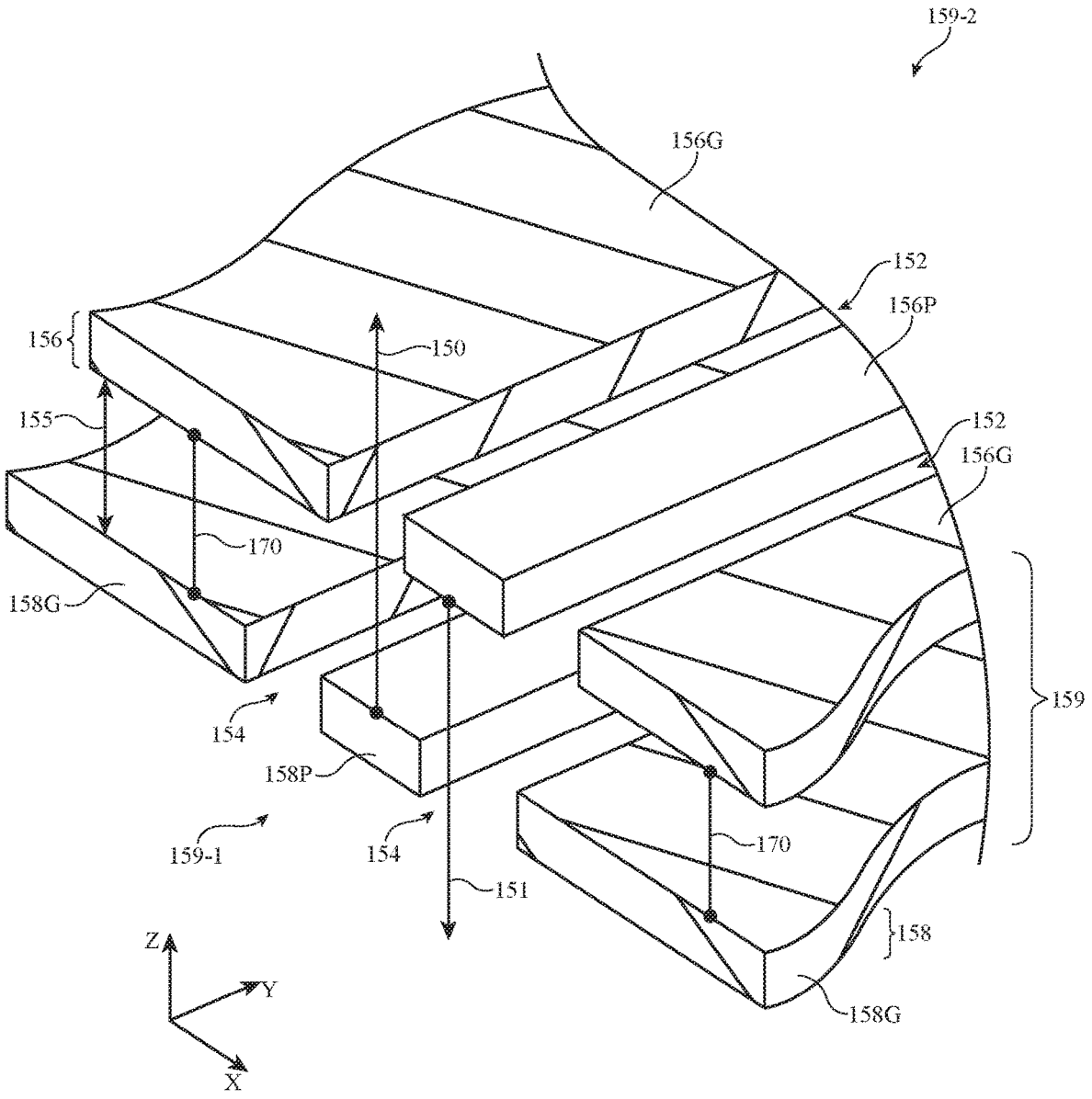
FIG. 11 is a perspective view of illustrative transmission line structures that may be used to convey millimeter wave signals for an integrated antenna module of the type shown in FIG. 10 in accordance with an embodiment.

FIG. 11 is a perspective view of transmission line structures 159 for antennas 40-1 and 40-2 formed at opposing sides of module 109 (e.g., as shown in FIG. 10). In the example of FIG. 11, dielectric layers 122 are not shown for the sake of clarity. As shown in FIG. 11, conductive traces 156 may be formed at distance 155 from conductive traces 158 (e.g., the thickness of layer 122-5 of FIG. 10 may be equal to distance 155).

Conductive traces 156 may include grounded portions 156G that are sometimes referred to herein as grounded segments, grounded traces, grounded conductors, or ground conductors. Conductive traces 156 may include signal-level portions such as signal portion 156P. Signal portion 156P may sometimes be referred to herein as a signal conductor, signal trace, or micro strip. Signal conductor 156P may be laterally interposed between two ground conductors 156G. Signal conductor 156P may be separated from the two adjacent ground conductors 156G by openings 152 in traces 156.

Conductive traces 158 may include grounded portions such as ground conductors 158G and signal-level portions such signal conductor 158P. Signal conductor 158P may be laterally interposed between two ground conductors 158G. Signal conductor 158P may be separated from the two adjacent ground conductors 158G by openings 154 in traces 158. If desired, ground conductors 156G may be shorted to corresponding ground conductors 158G over vertical conductive structures 170. Vertical conductive structures 170 may include conductive through-vias, metal pillars, metal wires, conductive pins, or any other desired vertical conductive interconnect structures. Ground conductors 156G and 158G may be held at a ground or reference potential, for example. Ground traces 156G and/or 158G may, if desired, be shorted to one or more dedicated ground ports 134 on transceiver 110 (FIG. 8).

Signal conductor 156P may be coupled to transceiver port 134-1 over vertical conductive structure 128-1 (FIG. 10). Signal conductor 158P may be coupled to transceiver port 134-2 over vertical conductive structure 128-2. Signal conductor 156P may be coupled to feed terminal 96-2 of antenna 40-2 over vertical conductor 151 and through opening 154 in traces 158 (e.g., vertical conductor 151 may extend through layers 122-5, 122-4, and 122-3 and opening 154 in traces 158). Signal conductor 158P may be coupled to feed terminal 96-1 of antenna 40-1 over vertical conductor 150 and through opening 152 in traces 156 (e.g., vertical conductor 150 may extend through layers 122-5, 122-6, and 122-7 and through opening 152 in traces 156).

Signal conductor 156P may convey antenna currents between transceiver port 134-2 and antenna feed terminal 96-2 on antenna 40-2. Corresponding signals (e.g., millimeter wave signals) for antenna 40-2 may be conveyed down the longitudinal length of signal conductor 156P (e.g., along the Y-axis of FIG. 11) between the adjacent ground traces 156G and the underlying ground traces 158G (e.g., from vertical conductive structure 128-2 to vertical conductive structure 151 as shown in FIG. 10).

Signal conductor 158P may convey antenna currents between transceiver port 134-1 and antenna feed terminal 96-1 on antenna 40-1. Corresponding signals (e.g., millimeter wave signals) for antenna 40-1 may be conveyed down the longitudinal length of signal conductor 158P (e.g., along the Y-axis of FIG. 11) between the adjacent ground traces 158G and the overlying ground traces 156G (e.g., from vertical conductive structure 128-1 to vertical conductive structure 150 as shown in FIG. 10).

In this way, transmission line structures 159 may be configured to include a coplanar waveguide 159-2 formed from signal conductor 156P, ground conductors 156G, and ground conductors 158G that conveys signals for antenna 40-2 and a coplanar waveguide 159-1 formed from signal conductor 158P, ground conductors 158G, and ground conductors 156G that conveys signals for antenna 40-1 (e.g., coplanar waveguide 159-2 may form a first transmission line 64 for antenna 40-2 having a signal path 91 formed from conductor 156P and ground path 94 formed from traces 156G and 158G, whereas coplanar waveguide 159-1 may form a second transmission line 64 for antenna 40-1 having a signal path 91 formed from conductor 158P and ground path 94 formed from traces 156G and 158G as shown in FIG. 4). Transmission lines 159-1 and 159-2 may sometimes be referred to as grounded coplanar transmission lines in scenarios where vertical conductive structures 170 are formed between traces 156G and 158G. Structures 170 may be omitted if desired.

When configured in this way, coplanar waveguide signal conductor 156P for antenna 40-2 may be interposed or located between antenna 40-1 and coplanar waveguide signal conductor 158P for antenna 40-1. Similarly, signal conductor 158P for antenna 40-1 may be interposed between antenna 40-2 and signal conductor 156P for antenna 40-2. Ground traces 156G may extend across the lateral area of module 109 under antenna resonating element 104-1 and may form antenna ground plane 92 (FIGS. 5 and 6) for antenna 40-1. Similarly, ground traces 158G may extend across the lateral area of module 109 over resonating element 104-2 and may form antenna ground plane 92 for antenna 40-2. At the same time, ground traces 156G and 158G may serve to shield antenna 40-1 from antenna 40-2 and may serve to mitigate electromagnetic coupling between signal lines 156P and 158P (e.g., ground traces 156G may isolate signal conductor 156P from signals conveyed by signal conductor 158P and ground traces 158G may isolate signal conductor 158P from signals conveyed by signal conductor 156P). This may, for example, minimize interference between ports 134-1 and 134-2 and between signals conveyed by antennas 40-1 and 40-2.

The example of FIG. 11 is merely illustrative. In general, layer 156 may include a different respective signal conductor 156P for each feed terminal 96 on the antennas 40 adjacent to side 114 of module 109. For example, in scenarios where module 109 includes two antennas 40 adjacent to side 114 each having two feeds (e.g., as shown in FIG. 6), traces 156 may include four signal conductors 156P, each separated from the other signal conductors 156P by at least one ground trace 156G. Similarly, in scenarios where module 109 includes four antennas 40 adjacent to side 112 each having two feeds, traces 158 may include eight signal conductors 156P, each separated from the other signal conductors 158P by at least one ground trace 158G. As another example, in scenarios where module 109 includes four antennas 40 adjacent to side 112 and four antennas 40 adjacent to side 114, each having two feeds, structures 159 may include sixteen coplanar waveguides, traces 156 may include eight signal conductors 156P separated by ground conductors 156G for the antennas adjacent to side 114, and traces 158 may include eight signal conductors 158P separated by ground conductors 158G for the antennas adjacent to side 112. Each signal conductor 156P may be coupled to antenna resonating elements 104 adjacent to side 114 through the same opening in traces 158 or through different openings in traces 158 (e.g., through respective openings between signal and ground conductors in traces 158, through openings within ground conductors 158G, etc.). Each signal conductor 158P may be coupled to antenna resonating elements 104 adjacent to side 112 through the same opening in traces 156 or through different openings in traces 156. Forming the transmission lines for antennas 40 using coplanar waveguide structures 159 may ensure that each of the signal conductors are sufficiently isolated regardless of the number of antennas 40 and feeds 100 that are formed adjacent to one or both sides of module 109. If desired, both waveguide structures of the type shown in FIGS. 8 and 9 may be formed together with waveguide structures of the type shown in FIGS. 10 and 11 within the same module 109 (e.g., for feeding different antennas on one and/or both sides of module 109).

Figure 12:
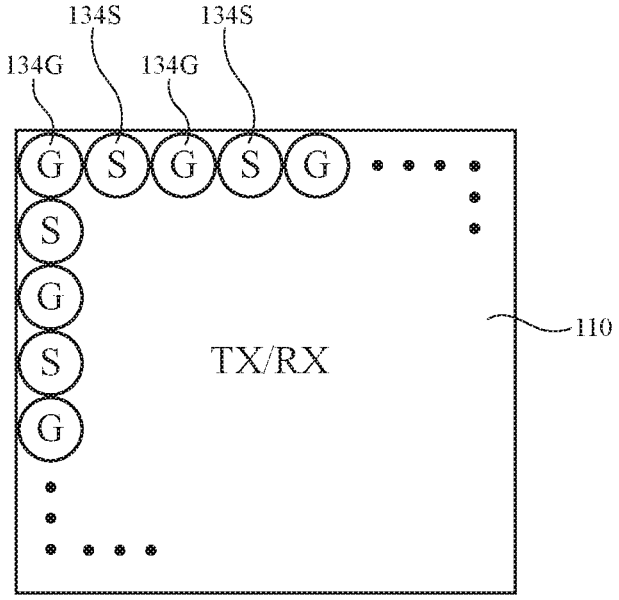
FIG. 12 is a top-down view of an illustrative transceiver having alternating signal and ground ports in accordance with an embodiment.

FIG. 12 is a top-down view showing how ports 134 may be arranged on transceiver 110 of FIGS. 8 and 10. As shown in FIG. 12, ports 134 may be arranged around the periphery of transceiver 110. Ports 134 may include signal ports 134S that are each coupled to a corresponding signal conductor in the coplanar waveguide structures of module 109 (e.g., coplanar waveguide structures 137 of FIGS. 8 and 9 or coplanar waveguide structures 159 of FIGS. 10 and 11). Ports 134 may include ground ports 134G that each coupled to a corresponding ground antenna feed terminal 98 (FIGS. 5 and 6). Transceiver circuitry 110 may, for example, include at least one signal port 134S and at least one ground port 134G for each antenna feed 100 that is formed on module 109. As shown in FIG. 12, each signal port 134S may be interposed between two adjacent ground ports 134G (e.g., each ground port 134G may be interposed between two signal ports 134S). Arranging ports 134 in this way may, for example, further enhance the isolation between signal ports 134S at the interface between transceiver 110 and vertical conductive structures 128 (FIGS. 8 and 10). This example is merely illustrative and, in general, ports 134 may be arranged in any desired manner.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

transceiver circuitry;

first and second antenna resonating elements;

a first coplanar waveguide configured to convey first signals at a frequency greater than 10 GHz between the transceiver circuitry and the first antenna resonating element; and a second coplanar waveguide configured to convey second signals at a frequency greater than 10 GHz between the transceiver circuitry and the second antenna resonating element, wherein the first coplanar waveguide is interposed between the second coplanar waveguide and the second antenna resonating element and the second coplanar waveguide is interposed between the first coplanar waveguide and the first antenna resonating element.

2. The apparatus defined in claim 1, wherein the first coplanar waveguide comprises a first signal conductor coupled between the transceiver circuitry and a first antenna feed terminal on the first antenna resonating element and a first ground conductor that is separated from the first signal conductor by a first opening, the second coplanar waveguide being coupled to a second antenna feed terminal on the second antenna resonating element through the first opening.

3. The apparatus defined in claim 2, wherein the second coplanar waveguide comprises a second signal conductor that is coupled between the transceiver circuitry and the second antenna feed terminal and a second ground conductor that is separated from the second signal conductor by a second opening, the first signal conductor being coupled to the first antenna feed terminal through the second opening.

4. The apparatus defined in claim 3, further comprising:

a third coplanar waveguide configured to convey third signals at a frequency greater than 10 GHz between the transceiver circuitry and a third antenna feed terminal on the first antenna resonating element, wherein the third coplanar waveguide is interposed between the second coplanar waveguide and the second antenna resonating element.

5. The apparatus defined in claim 4, wherein the third coplanar waveguide is coplanar with the first coplanar waveguide.

6. The apparatus defined in claim 4, wherein the third coplanar waveguide comprises a third signal conductor coupled between the transceiver circuitry and the third antenna feed terminal, wherein the first ground conductor is interposed between the first and third signal conductors.

7. The apparatus defined in claim 6, further comprising:

a fourth coplanar waveguide configured to convey fourth signals at a frequency greater than 10 GHz between the transceiver circuitry and a fourth antenna feed terminal on the second antenna resonating element, wherein the fourth coplanar waveguide is interposed between the first coplanar waveguide and the first antenna resonating element.

8. The apparatus defined in claim 3, wherein the second ground conductor is shorted to the first ground conductor.

9. The apparatus defined in claim 3, wherein the first antenna resonating element comprises a first patch antenna resonating element for a first patch antenna, the second antenna resonating element comprises a second patch antenna resonating element for a second patch antenna, the second ground conductor is configured to form a first antenna ground plane for the first patch antenna, and the first ground conductor is configured to form a second antenna ground plane for the second patch antenna.

10. The apparatus defined in claim 9, wherein the transceiver circuitry comprises first, second, and third ports, the second port is interposed between the first and third ports, the first port is coupled to the first signal conductor, the third port is coupled to the second signal conductor, and the second port is coupled to the first ground conductor.

11. Apparatus, comprising:

a stacked dielectric substrate having a first layer, a second layer, a third layer, and a fourth layer, wherein the second layer is interposed between the first and third layers and the third layer is interposed between the second and fourth layers;

first metal traces on the first layer, wherein the first metal traces form a first antenna resonating element for a first millimeter wave antenna;

second metal traces on the second layer;

third metal traces on the third layer, wherein the third metal traces form a first coplanar waveguide that conveys millimeter wave signals for the first millimeter wave antenna; and fourth metal traces on the fourth layer, wherein the fourth metal traces form a second antenna resonating element for a second millimeter wave antenna and the second metal traces form a second coplanar waveguide that conveys millimeter wave signals for the second millimeter wave antenna.

12. The apparatus defined in claim 11, further comprising:

a first conductive via coupled between the third metal traces and a first antenna feed terminal for the first millimeter wave antenna on the first metal traces; and a second conductive via coupled between the second metal traces and a second antenna feed terminal for the second millimeter wave antenna on the fourth metal traces.

13. The apparatus defined in claim 12, wherein the third metal traces comprise a first signal conductor for the first coplanar waveguide, the second metal traces comprise a second signal conductor for the second coplanar waveguide, the first conductive via extends from the first signal conductor through the third layer, a first opening in the second metal traces, and the second layer to the first antenna feed terminal, and the second conductive via extends from the second signal conductor through the third layer, a second opening in the third metal traces, and the fourth layer to the second antenna feed terminal.

14. The apparatus defined in claim 13, wherein the third metal traces further comprise first and second ground conductors, the first signal conductor is interposed between the first and second ground conductors, and the first and second ground conductors form an antenna ground plane for the second millimeter wave antenna.

15. The apparatus defined in claim 14, wherein the second conductive traces further comprise third and fourth ground conductors, the second signal conductor is interposed between the third and fourth ground conductors, and the third and fourth ground conductors form an antenna ground plane for the first millimeter wave antenna.

16. The apparatus defined in claim 15, further comprising:

a third conductive via that is coupled between the first and third ground conductors through the third layer; and a fourth conductive via that is coupled between the second and fourth ground conductors through the third layer.

17. The apparatus defined in claim 15, further comprising:

transceiver circuitry having first and second ports;

a third conductive via that extends through the first, second, and third layers and that couples the first signal conductor to the first port of the transceiver circuitry; and a fourth conductive via that extends through the first and second layers and that couples the second signal conductor to the second port of the transceiver circuitry.

18. The apparatus defined in claim 11, wherein the stacked dielectric substrate further comprises fifth and sixth layers, the fourth layer is interposed between the third metal traces and the sixth layer, and the first layer is interposed between the first metal traces and the fifth layer, further comprising:

fifth metal traces on the fifth layer, wherein the fifth metal traces form a first parasitic antenna resonating element for the first millimeter wave antenna; and sixth metal traces on the sixth layer, wherein the sixth metal traces form a second parasitic antenna resonating element for the second millimeter wave antenna.

19. An electronic device comprising:

a stacked dielectric substrate having a first layer, a second layer over the first layer, and a third layer over the second layer;

first metal traces on the first layer, wherein the first metal traces form an antenna ground for first and second antennas, a first coplanar waveguide transmission line for the first antenna, and a second coplanar waveguide transmission line for the second antenna;

second metal traces on the third layer, wherein the second metal traces form a first patch antenna resonating element for the first antenna and a second patch antenna resonating element for the second antenna; and transceiver circuitry that is configured to transmit first signals to the first antenna over the first coplanar waveguide transmission line and second signals to the second antenna over the second coplanar waveguide transmission line, wherein the first and second signals are at frequencies between 10 GHz and 300 GHz.

20. The electronic device defined in claim 19, wherein the first layer has first and second opposing sides, a first portion of the first metal traces is formed on the first side of the first layer, a second portion of the first metal traces is formed on the second side of the first layer, the first portion of the first metal traces forms the antenna ground for first antenna, and the second portion of the metal traces form the first coplanar waveguide transmission line for the first antenna.

* * * * *